US008500251B2

(12) United States Patent
Kubo

(10) Patent No.: US 8,500,251 B2
(45) Date of Patent: Aug. 6, 2013

(54) INK-JET RECORDING APPARATUS

(75) Inventor: Tomoyuki Kubo, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 1588 days.

(21) Appl. No.: 11/028,897

(22) Filed: Jan. 3, 2005

(65) Prior Publication Data

US 2005/0151796 A1 Jul. 14, 2005

(30) Foreign Application Priority Data

Jan. 9, 2004 (JP) ..... 2004-003657

(51) Int. Cl.
*B41J 2/05* (2006.01)

(52) U.S. Cl.
USPC ..... 347/58; 347/43; 347/54; 347/40

(58) Field of Classification Search
USPC ..... 347/58, 100, 54, 40, 17, 6, 43
See application file for complete search history.

(56) References Cited

U.S. PATENT DOCUMENTS

| | | | | |
|---|---|---|---|---|
| 4,540,996 | A * | 9/1985 | Saito | 347/43 |
| 5,030,971 | A | 7/1991 | Drake et al. | |
| 5,371,531 | A * | 12/1994 | Rezanka et al. | 347/43 |
| 6,086,185 | A | 7/2000 | Inui et al. | |
| 6,145,961 | A | 11/2000 | Otsuki | |
| 6,281,914 | B1 * | 8/2001 | Hiwada et al. | 347/50 |
| 6,315,387 | B1 * | 11/2001 | Horikoshi | 347/40 |
| 6,352,331 | B1 * | 3/2002 | Armijo et al. | 347/19 |
| 6,386,672 | B1 * | 5/2002 | Kimura et al. | 347/18 |
| 6,478,398 | B2 * | 11/2002 | Dietl et al. | 347/15 |
| 6,679,595 | B2 | 1/2004 | Yamada et al. | |
| 6,715,862 | B2 | 4/2004 | Takagi et al. | |
| 2002/0093545 | A1 | 7/2002 | Shirakawa | |
| 2002/0105567 | A1 * | 8/2002 | Yamada et al. | 347/87 |
| 2003/0063449 | A1 * | 4/2003 | Suzuki et al. | 361/777 |
| 2004/0125177 | A1 | 7/2004 | Sakaida et al. | |
| 2005/0231543 | A1 | 10/2005 | Hosono | |
| 2006/0250451 | A1 | 11/2006 | Suzuki et al. | |

FOREIGN PATENT DOCUMENTS

| | | |
|---|---|---|
| JP | 6-135013 | 5/1994 |
| JP | 7195715 | 8/1995 |
| JP | 10278280 | 10/1998 |
| JP | 2000-037869 | 2/2000 |

(Continued)

*Primary Examiner* — Matthew Luu
*Assistant Examiner* — Henok Legesse
(74) *Attorney, Agent, or Firm* — Frommer Lawrence & Haug LLP

(57) ABSTRACT

An ink-jet recording apparatus includes a recording head which jets inks, and a cable which is connected to the recording head and which is provided with a driving circuit for applying a driving voltage of the recording head. The recording head is formed with nozzle arrays for jetting an ink of a dark color and an ink of a light color respectively. The nozzle array, which jets the ink of the dark color, is disposed farther from the driving circuit than the nozzle array which jets the ink of the light color. The nozzle array, which jets the ink of the dark color, is hardly affected by the heat from the driving circuit. Therefore, the deterioration of the recording quality, which would be otherwise caused by the disturbance of ink discharge from nozzles, is suppressed.

21 Claims, 7 Drawing Sheets

(56) References Cited

FOREIGN PATENT DOCUMENTS

| | | |
|---|---|---|
| JP | 2000-141702 | 5/2000 |
| JP | 2002-29115 | 1/2002 |
| JP | A-2002-240306 | 8/2002 |
| JP | 2002-254617 | 9/2002 |
| JP | 2002-361876 | 12/2002 |
| JP | A-2003-80793 | 3/2003 |
| JP | 2003-182069 | 7/2003 |
| WO | WO-03/097363 | 11/2003 |

* cited by examiner

INK-JET RECORDING APPARATUS

BACKGROUND OF THE INVENTION

1. Field of the Invention

The present invention relates to an ink-jet recording apparatus. In particular, the present invention relates to an ink-jet recording apparatus in which nozzles for discharging inks of a plurality of colors are arranged or aligned so that the influence of heat exerted by a driving circuit is inconspicuous.

2. Description of the Related Art

As disclosed in Japanese Patent Application Laid- open Nos. 2002-240306 (FIGS. 4 and 6) corresponding to U.S. Pat. Nos. 6,679,595 and 2003-80793 (FIGS. 6, 9, and 14) corresponding to U.S. Patent Application Publication No. 2003/0063449 A1, an ink-jet recording apparatus is known, in which inks are discharged from a recording head to perform the recording on a recording medium. The recording head includes a plurality of nozzles which are arranged in arrays, a cavity plate which has a plurality of pressure chambers and which is formed to have a substantially rectangular stacked structure, and a piezoelectric actuator plate which is adhered to and stacked on the cavity plate. A flexible wiring board (wiring member), which is electrically connected to respective piezoelectric actuators provided for the piezoelectric actuator plate, is superimposed and stacked on the piezoelectric actuator plate. An IC chip (driving circuit), which outputs the driving signal for discharging the inks from the nozzles, is arranged on the flexible wiring board.

The recording head is divided into two pieces. The flexible wiring board is connected to each of the two recording head pieces. The IC chip is arranged on each of the flexible wiring boards. The two flexible wiring boards extend in an identical direction and in the direction of arrangement of the nozzles which are arranged in arrays.

In the case of the conventional ink-jet recording apparatus, the respective nozzle arrays, which correspond to the inks of the plurality of colors, are disposed at equal distances from the IC chip, because the flexible wiring board extends in the direction of extension of the nozzle arrays. When the IC chip generates the heat as the recording head is driven, the nozzles for the respective colors are affected equivalently by the heat of the IC chip. The discharge characteristic of the ink to be discharged from the nozzles is changed depending on whether the temperature is low or high. In the case of the pale or light color such as the yellow ink, the disturbance is inconspicuous even when the landing position and/or the dot size is disturbed on the recording medium. However, in the case of the deep or dark color, for example, in the case of the black ink, the disturbance is conspicuous. Therefore, the disturbance appears as the deterioration of the recording quality.

In the case of the ink-jet recording apparatus as described above, the lateral width of the flexible wiring board is disposed in a direction substantially perpendicular to the direction of arrangement of the nozzles, which is narrow. For this reason, when the number of nozzles is increased in order to realize a high quality of the recording on the recording medium, the following problem has arisen. That is, the number of wirings formed along the lateral width of the flexible wiring board is further increased, and the wiring density is raised. The wirings are formed extremely finely. The production becomes difficult, and the production cost becomes expensive.

Further, in the case of the ink-jet recording apparatus as described above, the difference in the distance from the IC chip is increased at the both ends of the nozzle arrays for every respective inks. Therefore, the following problem has arisen.

That is, the signals, which are inputted from the IC chip into the respective piezoelectric actuators, are affected by the wiring resistance on the flexible wiring board. The discharge characteristics of the inks are changed at the both ends of the nozzle arrays, and the recording quality on the recording medium is deteriorated.

In view of the above, the inventors have proposed the following structure as disclosed in U.S. Pat. No. 6,715,862 and United States Patent Application Publication No. 2004/0125177 in order to widen the lateral width of the flexible wiring board. That is, the flexible wiring board is extended in the direction substantially perpendicular to the direction of arrangement of the nozzles, and the IC chip is arranged in the vicinity of the recording head. In such a structure, the difference is decreased in the distance from the IC chip to the both ends of the nozzle arrays, and the influence of the wiring resistance of the flexible wiring board is decreased. However, a problem has arisen such that the recording is disturbed, and the recording quality is deteriorated.

SUMMARY OF THE INVENTION

The present invention has been made in order to solve the problem as described above, an object of which is to provide an ink-jet recording apparatus which is capable of performing the high quality recording when the apparatus is provided with a recording head such that a flexible wiring board is extended in a direction substantially perpendicular to a direction of arrangement of nozzles, and an IC chip is arranged in the vicinity of the recording head.

According to a first aspect of the present invention, there is provided an ink-jet recording apparatus comprising:

- at least one recording head which discharges inks of a plurality of colors onto a recording medium to perform recording and which is formed with a plurality of nozzle arrays for jetting the inks of the plurality of colors respectively, each of the nozzle arrays including a plurality of nozzles arranged in a first direction;
- at least one flexible wiring member which extends from the recording head in a second direction perpendicular to the first direction; and
- at least one driving circuit which is arranged on the flexible wiring member and which outputs a driving signal to discharge the ink from the nozzles, wherein:
- a nozzle array of the nozzle arrays, which jets an ink of a dark color of the plurality of ink colors is arranged in the recording head farther from the driving circuit than a nozzle array of the nozzle arrays, which jets an ink of a light color of the plurality of ink colors.

According to the ink-jet recording apparatus of the present invention, the recording head has the plurality of nozzles arranged in array in the first direction for each of the ink colors. The flexible wiring member extends from the recording head in the second direction perpendicular to the first direction. The driving circuit, which outputs the driving signal to discharge the ink from the nozzles, is arranged on the wiring member. Therefore, the wiring from the driving circuit to the recording head, which is formed in the wiring member, can be formed within a width corresponding to the length of the nozzle array. Therefore, the wiring density can be lowered as compared with a case in which the wiring member extends in the first direction. The wiring can be formed with ease, and it is possible to reduce the production cost.

The inventors have analyzed the problem of the deterioration of the recording quality in the structure disclosed in U.S. Pat. No. 6,715,862 and United States Patent Application Laid-open No. 2004/0125177. As a result, the following cause has been found out. That is, the atmospheric temperature of the nozzle array differs because of the difference in the distance from the IC chip to the nozzle array for each of the ink colors. Consequently, the jetting characteristic of the nozzle array is dispersed. Particularly, it has been found out that when the IC chip is disposed near to the nozzles at a spacing distance from the nozzles by about 2 cm or by less than 2 cm, the influence of heat to the nozzle array from the IC chip becomes conspicuous. Accordingly, in the present invention, the nozzles of the recording head are arranged for the plurality of ink colors such that the nozzle array, which corresponds to the dark ink color, is disposed at the position farther from the driving circuit than the nozzle array which corresponds to the light ink color. Therefore, even when the driving circuit generates the heat, the recording disturbance is decreased for the nozzles of the dark ink color, because the influence of the heat is decreased. Thus, it is possible to perform the high quality recording. The ink of the dark ink color may be a black ink. Accordingly, it is possible to record documents including letters or the like at the high quality.

In the ink-jet recording apparatus, the ink of the dark color may be an ink of the darkest color, and the ink of the light color may be an ink of the lightest color. In this case, the nozzle arrays of the recording head may be arranged for the plurality of ink colors such that the nozzle array, which corresponds to the lightest ink color, may be disposed at a position nearest to the driving circuit, for the following reason. That is, in the case of the ink of the light color, the recording disturbance is hardly conspicuous, even when the discharge characteristic from the nozzles is changed by being affected by the heat from the driving circuit. Therefore, it is possible to perform the high quality recording.

In the ink-jet recording apparatus, as the color of the ink becomes darker, the nozzle array which jets the ink of darker colors may be arranged farther from the driving circuit. Therefore, even when the driving circuit generates the heat, then the darker ink color is affected by the heat to a smaller extent, and it is possible to decrease the recording disturbance. The disturbance is more inconspicuous in the case of the lighter ink color, even when the recording is disturbed by the influence of the heat. Therefore, it is possible to perform the high quality recording.

The inks of the plurality of colors may include at least two inks of colors which are substantially equivalent in lightness and darkness, and a nozzle array of the nozzle arrays, which jets an ink of a color which is more frequently discharged, of the at least two inks, may be arranged far from the driving circuit. When the arrangement is made as described above, it is possible to decrease the influence brought about by the heat generation of the portion of the recording head corresponding to the nozzle array having the high discharge frequency and by the thermal conduction from the driving circuit to the recording head. Thus, it is possible to perform the high quality recording.

In the ink-jet recording apparatus, a number of the nozzles formed for jetting the ink of the dark color may be larger than a number of the nozzles formed for jetting the ink of a color other than the dark color. Accordingly, the portion of the dark ink color can be recorded at a high speed or a high density while hardly causing the disturbance.

The recording head may include two head bodies which have the plurality of nozzle arrays respectively and which are arranged in the second direction; the flexible wiring member may include two wiring sections which are connected to the two head bodies and which extend in the second direction oppositely to each other; and the driving circuit may include circuits which are provided for the two wiring sections respectively. In this arrangement, the nozzle arrays for jetting the ink of the dark color may be arranged on sides nearer to mutually adjoining side edges of the two head bodies. As described above, when the nozzle arrays, which jet the dark color ink, are arranged as described above when the two head bodies are provided, then the nozzle arrays, which correspond to the dark ink color, are disposed at the positions farthest from the driving circuit, and it is possible to decrease the influence of the heat from the driving circuit.

The ink-jet recording apparatus may further comprises a heat sink which is arranged in contact with the driving circuit. The heat sink makes it possible to release the heat generated by the driving circuit to the outside. It is possible to reduce the thermal conduction to the recording head.

According to a second aspect of the present invention, there is provided an ink-jet recording apparatus comprising:

a recording head which discharges inks of a plurality of colors including a first color and a second color darker than the first color and which is formed with arrangement of a first nozzle group including a plurality of nozzles for jetting the ink of the first color and a second nozzle group including a plurality of nozzles for jetting the ink of the second color;

a wiring member which extends from the recording head in a direction of the arrangement of the first and second nozzle groups; and a driving circuit which is arranged on the wiring member and which outputs a driving signal for discharging the ink from the nozzles, wherein:

the driving circuit is positioned farther from the second nozzle group than from the first nozzle group.

DESCRIPTION OF THE PREFERRED EMBODIMENTS

Figure 1:
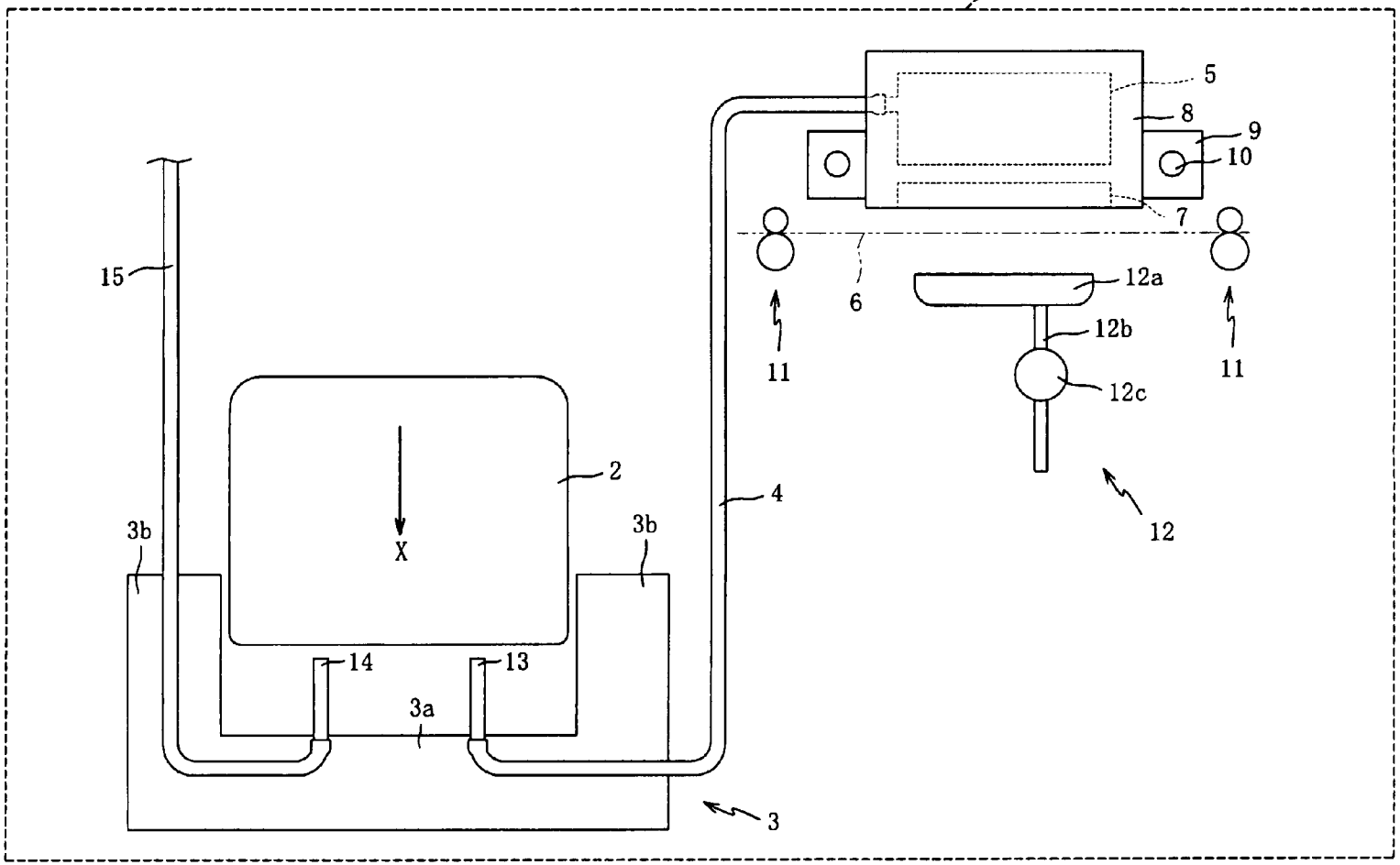
FIG. 1 schematically shows an ink-jet recording apparatus according to an embodiment of the present invention.

A preferred first embodiment according to the present invention will be explained below with reference to the accompanying drawings. FIG. 1 schematically shows an ink-jet recording apparatus 1 according to the first embodiment of the present invention, and an ink cartridge 2 to be installed to the ink-jet recording apparatus 1.

The ink-jet recording apparatus 1 includes a mounting unit 3 to which an ink cartridge 2 is detachably mounted, an ink tank 5 which stores the ink supplied from the ink cartridge 2 through an ink supply tube 4, a recording head 7 which discharges the ink stored in the ink tank 5 toward a recording medium 6, a carriage 9 which carries a recording head unit 8 provided with the ink tank 5 and the recording head 7 and which makes the reciprocating motion in the linear direction, a carriage shaft 10 which guides the reciprocating motion of the carriage 9, a transport mechanism 11 which transports the recording medium 6, and a purge unit 12. It is assumed that white printing paper is used as the recording medium 6 in the first embodiment.

The ink cartridge 2 is provided for each of color inks of a plurality of colors including, for example, cyan, magenta, yellow, and black. The ink cartridge 2 is mounted to the ink-jet recording apparatus 1 to make it possible to perform the color printing.

The mounting unit 3 is composed of a base section 3*a* and guide sections 3*b* which are provided upstandingly at both sides of the base section 3*a*. A hollow ink-extracting tube 13 for extracting the ink stored in the ink cartridge 2 and a hollow outside air-introducing tube 14 for introducing the outside air into the ink cartridge 2 are arranged to protrude from the base section 3*a* which is interposed between the guide sections 3*b*.

An ink supply tube 4 is connected to one end of the ink-extracting tube 13. The ink-extracting tube 13 is communicated with the ink tank 5 through the ink supply tube 4. An outside air-introducing conduit 15 is connected to one end of the outside air-introducing tube 14. The outside air-introducing tube 14 is communicated with the outside air through the outside air-introducing conduit 15.

The purge unit 12 is arranged without the recording range so that the purge unit 12 is opposed to the recording head 7. The purge unit 12 includes a purge cap 12*a* which covers the surface of formation of nozzles 16 (16*y*2, 16*c*2, 16*m*2, 16*k*2, 16*k*1, 16*m*1, 16*c*1, 16*y*1) of the recording head 7 (see FIG. 3), a drain ink tube 12*b* which is communicated with the purge cap 12*a*, and a pump 12*c* which sucks the ink from the nozzles 16 through the drain ink tube 12*b*.

Figure 2:
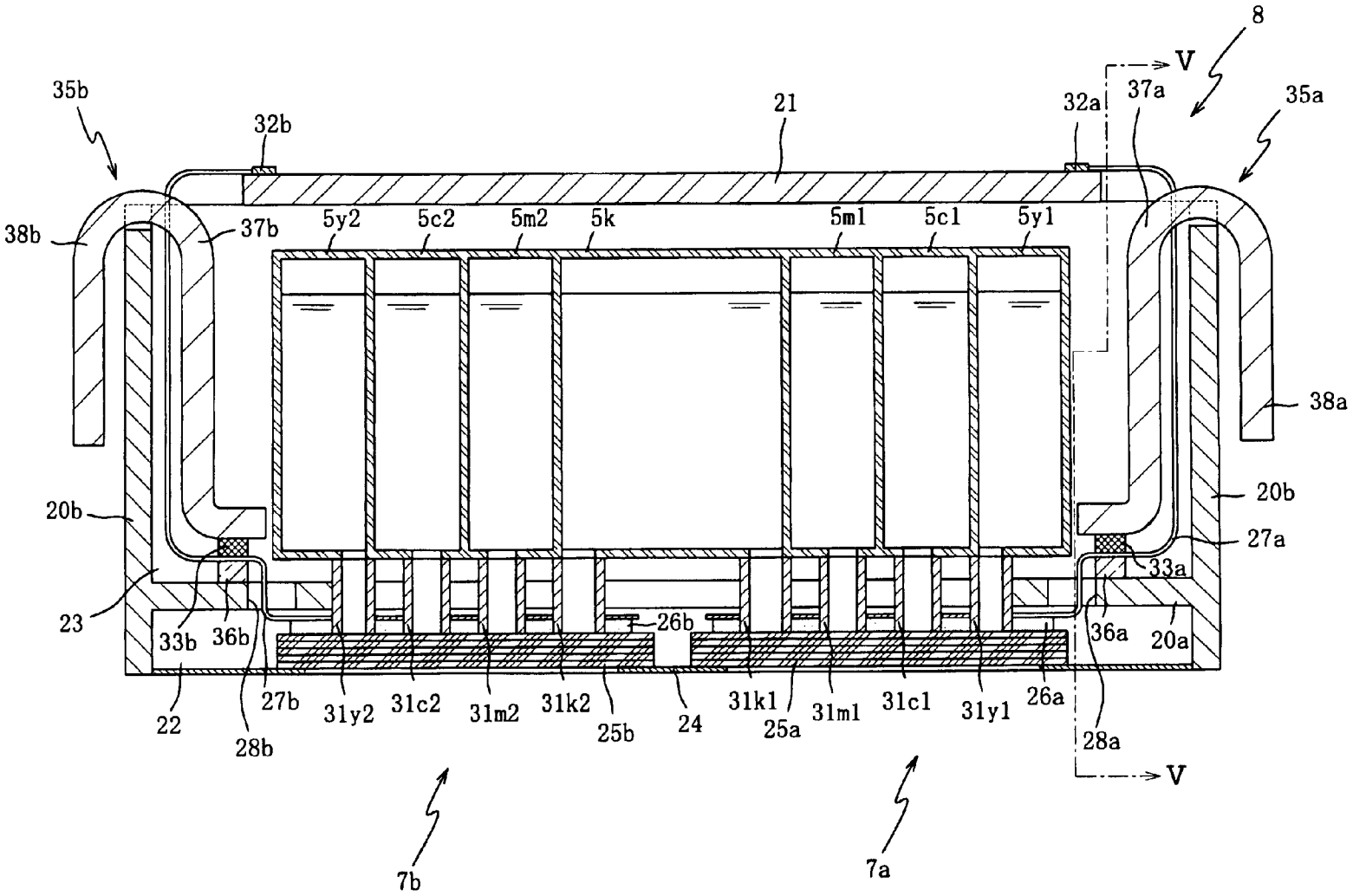
FIG. 2 shows a sectional view illustrating a recording head unit.
Figure 3:
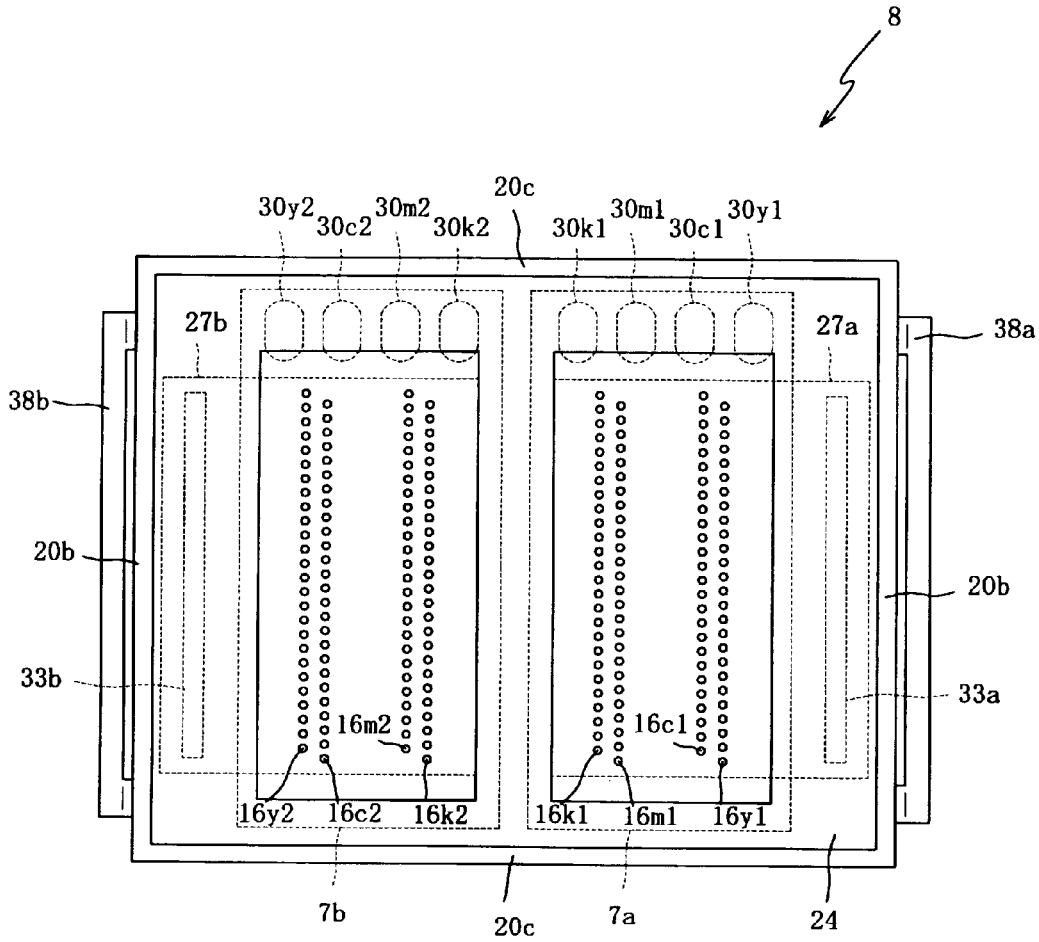
FIG. 3 shows a bottom view illustrating the recording head unit.
Figure 4:
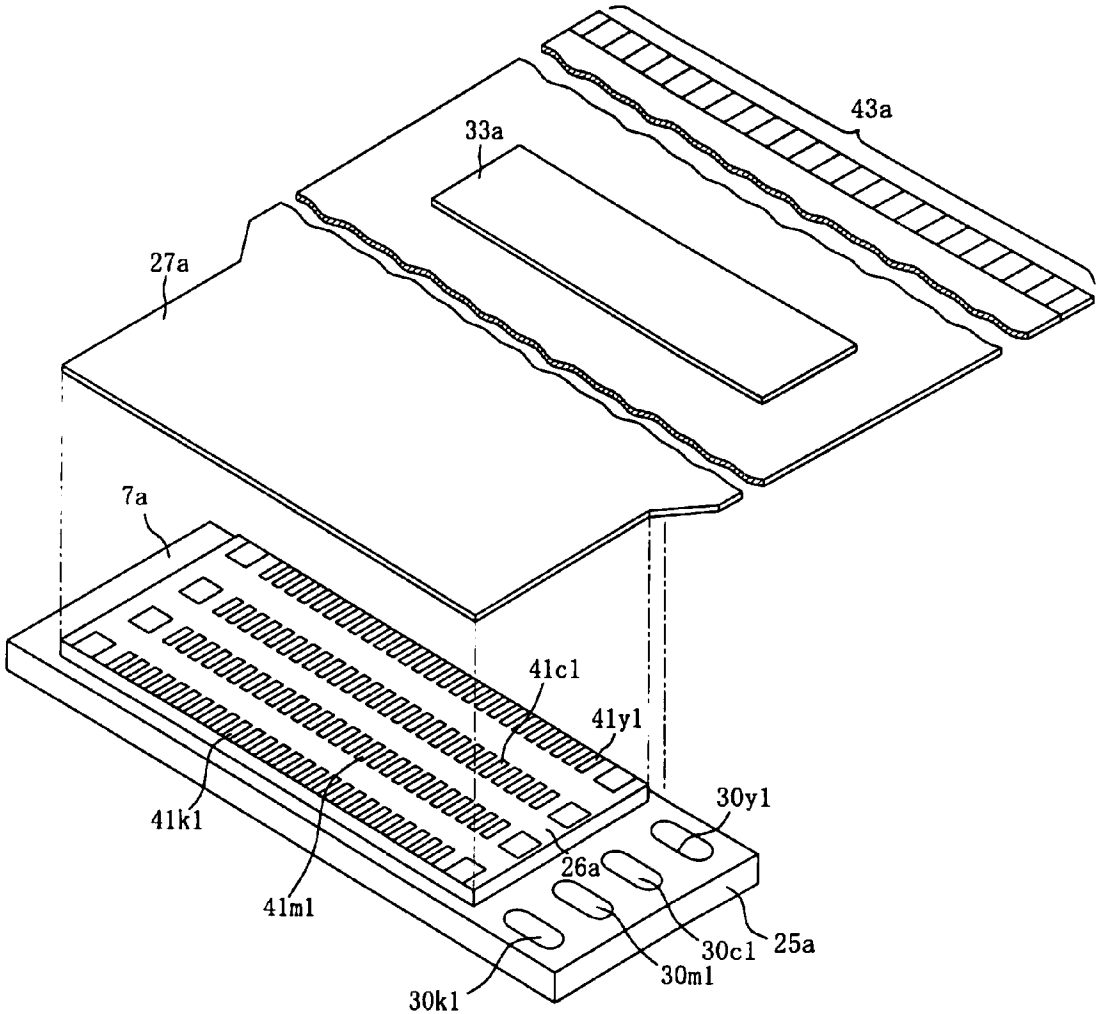
FIG. 4 shows an exploded perspective view illustrating a recording head and a flexible wiring board.
Figure 5:
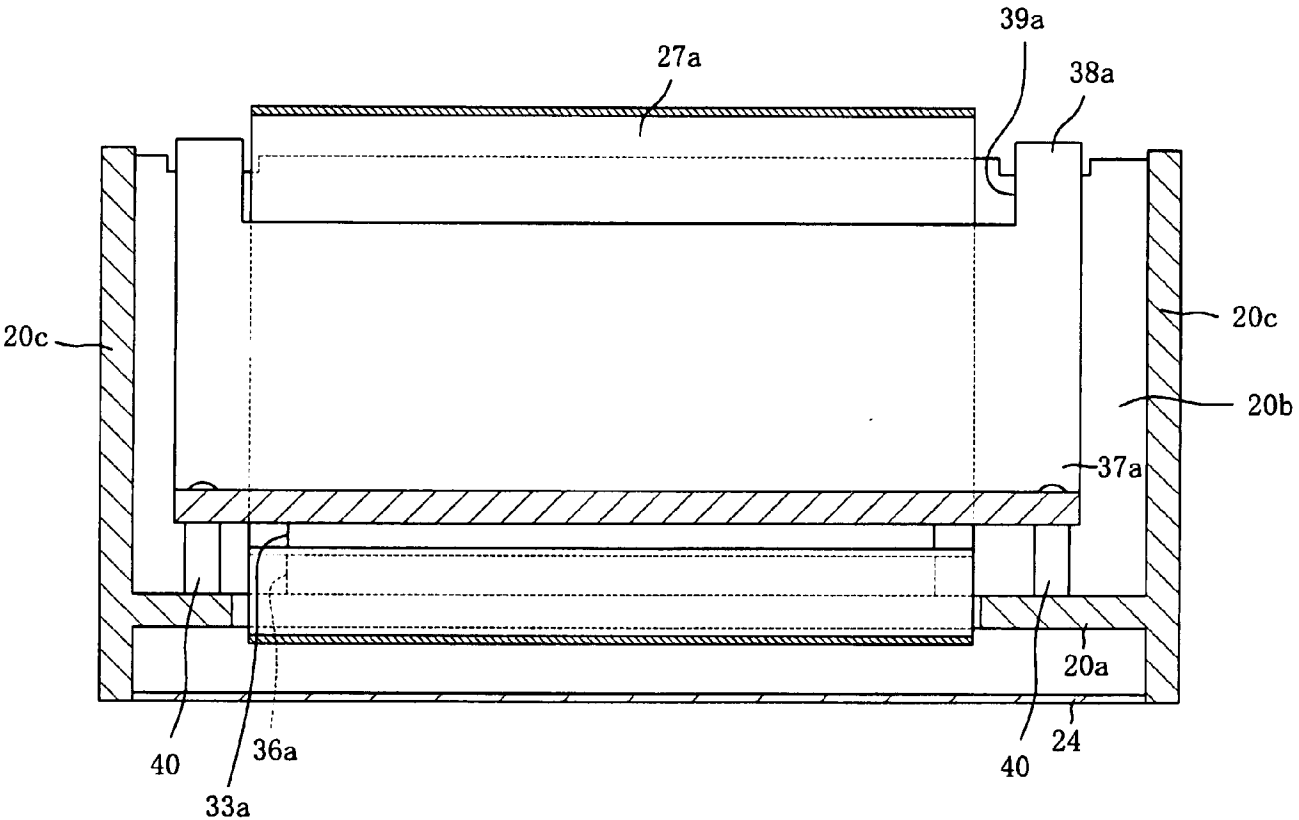
FIG. 5 shows a sectional view taken along a line V-V shown in FIG. 2.

Next, an explanation will be made with reference to FIGS. 2 to 5 about the structure of the recording head unit 8. FIG. 2 shows a sectional view, FIG. 3 shows a bottom view, FIG. 4 shows an exploded perspective view illustrating a recording head 7*a* and a flexible wiring board 27*a*, and FIG. 5 shows a sectional view taken along a line V-V shown in FIG. 2.

As described above, the recording head unit 8 is provided with the ink tank 5 and the recording head 7. The recording head unit 8 further includes a head holder 20 (20*a*, 20*b*) in which the ink tank 5 is arranged inside and which supports the recording head 7, and a printed circuit board 21 which is positioned over the head holder 20 and which is connected, via a flexible cable, to a control circuit stationarily placed on the main body side of the ink-jet recording apparatus 1.

The recording head 7 includes two pieces 7*a*, 7*b* which are supported at the bottom of the head holder 20 opposed to the recording medium 6. The nozzles 16 (16*y*2, 16*c*2, 16*m*2, 16*k*2, 16*k*1, 16*m*1, 16*c*1, 16*y*1), which discharges the inks of a plurality of colors to the recording medium 6 in order to perform the recording, are arranged in arrays corresponding to the plurality of ink colors on the lower surfaces of the recording heads 7*a*, 7*b* (see FIG. 3). The recording heads 7*a*, 7*b* are supported in an aligned manner in the second direction substantially perpendicular to the direction of the nozzle arrays (hereinafter referred to as "first direction") so that the respective nozzle arrays are substantially in parallel to one another.

Those arranged in one array (one group) for the respective recording heads 7*a*, 7*b* include the nozzles 16*y*1, 16*y*2 to form the nozzle arrays for the yellow ink, the nozzles 16*c*1, 16*c*2 to form the nozzle arrays for the cyan ink, the nozzles 16*m*1, 16*m*2 to form the nozzle arrays for the magenta ink, and the nozzles 16*k*1, 16*k*2 to form the nozzle arrays for the black ink. The nozzles 16*k*1, 16*k*2 for the black ink of the respective recording heads are disposed adjacently to one another. As the positions are separated farther therefrom, the respective nozzles for the magenta ink, the cyan ink, and the yellow ink are arranged in this order so that the colors become lighter. The nozzles for the identical color of the two recording heads may be arranged on identical straight lines in the scanning direction of the carriage 9. Alternatively, the nozzles for the identical color of the two recording heads may be arranged while being deviated by half pitch in the nozzle array direction.

In general, the recording medium 6 is a sheet of printing paper having a white color or a light color (having a high brightness). Therefore, the darkest ink color of the plurality of ink colors is represented by the black ink to be discharged from the nozzles 16*k*1, 16*k*2. The lightest ink color is represented by the yellow ink to be discharged from the nozzles 16*y*1, 16*y*2.

The ink tank 5 includes two ink tanks 5*c*1, 5*c*2 for the cyan ink, two ink tanks 5*y*1, 5*y*2 for the yellow ink, two ink tanks 5*m*1, 5*m*2 for the magenta ink, and an ink tank 5*k* for the black ink depending on the colors of the respective inks. The respective ink tanks are connected to ink supply ports 30*y*1, 30*y*2, 30*c*1, 30*c*2, 30*m*1, 30*m*2, 30*k*1, 30*k*2 of the recording heads 7*a*, 7*b* as described later on, by the aid of tubes 31*y*1, 31*y*2, 31*c*1, 31*c*2, 31*m*1, 31*m*2, 31*k*1, 31*k*2.

The head holder 20 is formed to be substantially box-shaped by a pair of side walls 20*b* and a pair of side walls 20*c* which rise upstandingly in the vertical direction (see FIG. 3). The head holder 20 includes therein a bottom wall 20*a* which comparts a space 22 in which the recording heads 7*a*, 7*b* are arranged, and a space 23 in which the ink tanks 5 are arranged.

A closing member 24, which closes the space 22 and which is formed with exposure ports for exposing the respective nozzles 16 to the outside, is secured to the open lower surface of the head holder 20. The recording heads 7*a*, 7*b* are secured to the lower surface of the bottom wall 20*a* by the aid of an adhesive (not shown).

The respective recording heads 7*a*, 7*b* are composed of cavity plates 25*a*, 25*b* each of which is formed by stacking a plurality of plates, and plate-shaped piezoelectric actuator plates 26*a*, 26*b*. The cavity plates 25*a*, 25*b* have, on the upper surfaces, the ink supply ports 30*y*1, 30*y*2, 30*c*1, 30*c*2, 30*m*1, 30*m*2, 30*k*1, 30*k*2 (shown in FIG. 4 for only the recording head 7*a*). The inks are distributed to a plurality of pressure chambers through manifold flow passages which extend from the respective ink supply ports in the same manner as in a known apparatus described in U.S. Pat. No. 6,715,862. The disclosure of the contents of U.S. Pat. No. 6,715,862 is incorporated herein by reference. The inks arrive at the respective corresponding nozzles 16*y*1, 16*c*1, 16*m*1, 16*k*1, 16*y*2, 16*c*2, 16*m*2, 16*k*2 from the respective pressure chambers. The piezoelectric actuator plates 26*a*, 26*b* have a plurality of pressure-generating means, i.e., piezoelectric deforming sections corresponding to the respective pressure chambers. The piezoelectric actuator plates 26*a*, 26*b* have, on the upper surfaces, electrodes 41*y*1, 41*c*1, 41*m*1, 41*k*1, 41*y*2, 41*c*2, 41 m2, 41*k*2 (shown in FIG. 4 for only the recording head 7*a*) connected to the respective piezoelectric deforming sections.

Flexible circuit boards 27*a*, 27*b*, which have the flexibility, are stacked on the upper surfaces of the respective piezoelectric actuator plates 26*a*, 26*b* respectively. Wiring patterns (not shown), which extend from IC chips 33*a*, 33*b* that are internally installed with driving circuits carried on the respective flexible wiring boards 27*a*, 27*b*, are connected to the respective electrodes. When the driving pulses (driving signals) are supplied (outputted) from the IC chips 33*a*, 33*b* to the respective piezoelectric deforming sections of the piezoelectric actuator plates 26*a*, 26*b*, then the pressure is applied to the inks contained in the pressure chambers, and the inks can be discharged downwardly from the nozzles.

As shown in FIG. 4, the flexible wiring board 27*a* has the width in the array direction of the electrodes 41*y*1, 41*c*1, 41*m*1, 41*k*1, i.e., in the nozzle array direction. The flexible wiring boards 27*a*, 27*b* extend in the second direction opposingly to one another from the two recording heads 7*a*, 7*b*. As shown in FIG. 2, the flexible wiring boards 27*a*, 27*b* pass through communication passages 28*a*, 28*b* formed through the bottom wall 20*a*, and they enter the upper space 23. The flexible wiring boards 27*a*, 27*b* are arranged to extend upwardly in the head holder 20 substantially in parallel to the side walls 20*b* disposed on the both sides in the arrangement direction of the two recording heads 7*a*, 7*b*. Terminal sections 43*a*, which are disposed at the tips of the flexible wiring boards 27*a*, 27*b*, are connected respectively by connectors 32*a*, 32*b* to the printed circuit board 21 arranged over the head holder 20 (see FIGS. 2 and 4).

As shown in FIG. 2, rubber-like elastic members 36*a*, 36*b* are secured to the both sides (outer both sides of the communication passages 28*a*, 28*b*) of the bottom wall 20*a* in the arrangement direction of the recording heads 7*a*, 7*b*. The IC chips 33*a*, 33*b* are arranged thereon with the flexible wiring boards 27*a*, 27*b* intervening therebetween. The IC chips 33*a*, 33*b* are pressed by the rubber-like elastic members 36*a*, 36*b* to make contact so that the heat can be conducted to heat sinks 35*a*, 35*b*. As appreciated from FIG. 2, the IC chips 33*a*, 33*b* are respectively arranged at positions near to the bottom wall 20*a*. This is to prevent the increase in resistance which would be otherwise caused by a longer wiring pattern of the IC chips and the increase in cost which would be otherwise caused by a larger tape (film substrate) for TAB (Tape Automated Bonding).

As shown in FIG. 3, the distances from the IC chips 33*a*, 33*b* to the respective nozzles are prescribed as follows. That is, the nozzles 16*k*1, 16*k*2 for the black ink are disposed at the farthest positions, and the nozzles 16*y*1, 16*y*2 for the yellow ink are disposed at the nearest positions. In other words, the nozzles 16*k*1, 16*k*2 for the black ink are located at the positions separated farther from the respective IC chips 33*a*, 33*b* than the nozzles 16*y*1, 16*y*2 for the yellow ink. The nozzles 16*y*1, 16*y*2, the nozzles 16*c*1, 16*c*2, the nozzles 16*m*1, 16*m*2, and the nozzles 16*k*1, 16*k*2 are arranged in this order on the basis of the IC chips 33*a*, 33*b*. The nozzle arrays corresponding to the dark inks are arranged at the farther positions, and the nozzles corresponding to the light inks are arranged at the nearer positions.

As for the magenta ink and the cyan ink, when the lightness and darkness of the ink colors are substantially equivalent, the nozzles 16*m*1, 16*m*2 for the magenta ink, which have the higher discharge frequency, are arranged at the positions farther from the IC chips 33*a*, 33*b* than the nozzles 16*c*1, 16*c*2 for the cyan ink, for the following reason. That is, when the piezoelectric actuator is continuously driven, then the piezoelectric actuator itself generates the heat, and the discharge characteristic of the ink from the nozzles is changed. Therefore, it is intended to further decrease the influence of the heat from the IC chips 33*a*, 33*b*.

The heat sinks 35*a*, 35*b* make contact with the IC chips 33*a*, 33*b* so that the heat can be conducted, and the heat, which is generated by the IC chips 33*a*, 33*b*, is released to the outside. As shown in FIG. 2, the heat sinks 35*a*, 35*b* include side wall sections 37*a*, 37*b* which are arranged in parallel at spacing distances with respect to the side walls 20*b*, 20*b* at the inside of the side walls 20*b*, 20*b* disposed on the both sides of the two recording heads 7*a*, 7*b* in the arrangement direction, and exposure sections 38*a*, 38*b* which extend from the upper ends of the respective side wall sections 37*a*, 37*b*, which ride over the upper portions of the side walls 20*b*, 20*b* in inverted U-shaped forms, and which are exposed to the outside of the head holder 20.

As shown in FIG. 5, a through-hole 39*a*, which passes the flexible wiring board 27*a* from the side of the recording head 7*a* to the side of the printed circuit board 21 (see FIG. 2), is formed at a curved portion of the exposure section 38*a* of each of the heat sinks 35*a*, 35*b*. Each of the heat sinks 35*a*, 35*b* is attached by two attachment bosses 40 protruding on the bottom wall 20*a*, and each of the heat sinks 35*a*, 35*b* is attached in the head holder 20.

As described above, according to the ink-jet recording apparatus 1, the nozzles 16*k*1, 16*k*2 for the black ink, which are included in the nozzles corresponding to the four ink colors, are arranged at the positions separated farthest from the IC chips 33*a*, 33*b*, and the nozzles 16*y*1, 16*y*2 for the yellow ink are arranged at the nearest positions. In order to decrease the wiring resistance between the IC chips 33*a*, 33*b* and the piezoelectric actuators, if the IC chips 33*a*, 33*b* are arranged closely to the respective recording heads 7*a*, 7*b*, the heat generation of the IC chip, which is caused by the driving of the recording head, affects the recording head. The yellow ink, which is discharged from the nozzles 16*y*1, 16*y*1 that are easily affected by the heat, is inconspicuous on the recording layer. Therefore, the disturbance thereof is inconspicuous, even when the disturbance of the recording concerning, for example, the landing position and the dot diameter is caused. On the other hand, the conspicuous black ink is discharged from the nozzles 16*k*1, 16*k*2 which are hardly affected by the heat. Therefore, the recording is scarcely disturbed. As for other inks, when the lighter inks are arranged nearer to the IC chips 33*a*, 33*b*, the disturbance of the recording, which would be caused by the influence of the heat, can be made inconspicuous. Therefore, it is possible to perform the high quality recording.

Figure 6:
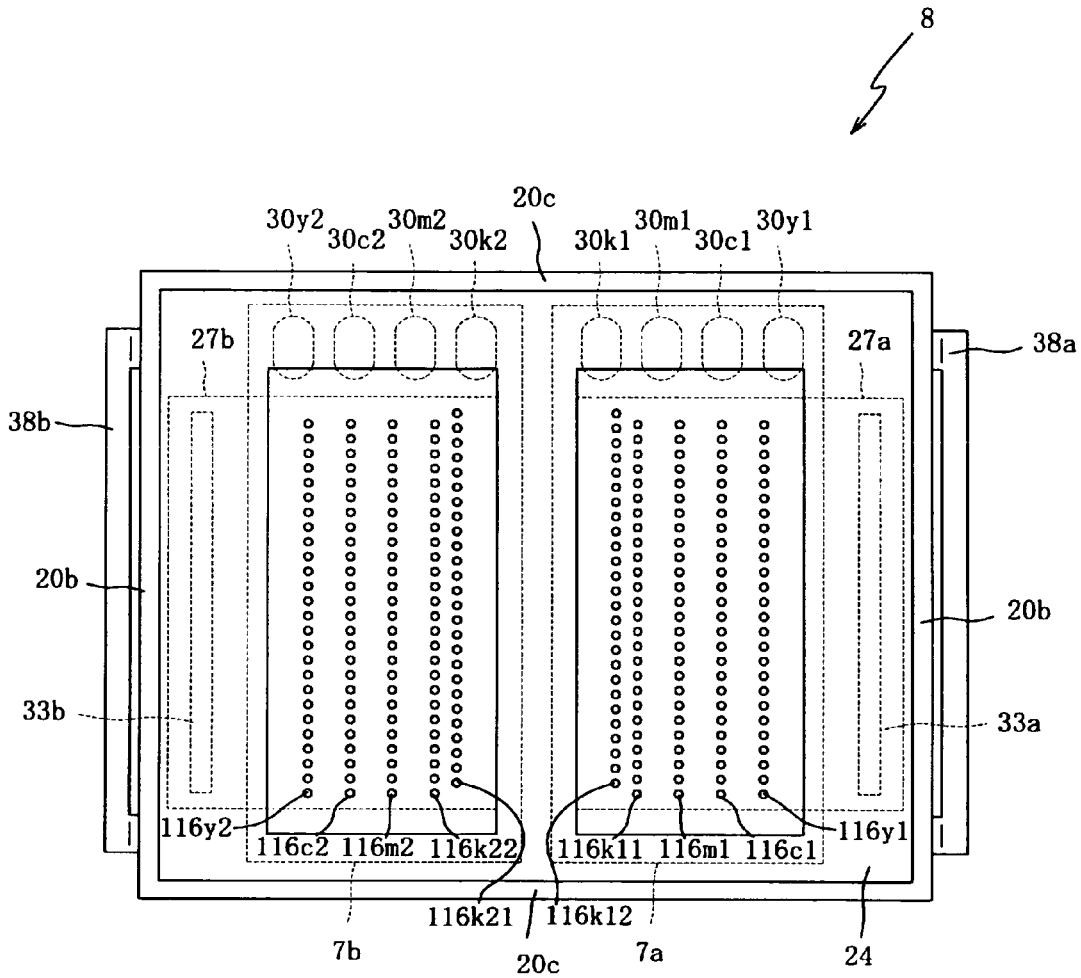
FIG. 6 shows a bottom view illustrating a recording head unit according to a second embodiment.

Next, an explanation will be made with reference to FIG. 6 about a state of arrangement of nozzle arrays of a recording head unit 8 of a second embodiment. FIG. 6 shows a bottom view illustrating the recording head unit 8 according to the second embodiment. The same parts as those of the first embodiment are designated by the same reference numerals, any explanation of which will be omitted.

The nozzle arrays of the recording head unit 8 of the second embodiment are arranged approximately in the same manner as in the first embodiment. However, nozzles 116*k*11, 116*k*12, 116*k*21, 116*k*22 for the black ink are arranged in two arrays in a zigzag lattice form on each of the recording heads 7*a*, 7*b*. Starting from these arrays, nozzles 116*m*1, 116*m*2, 116*c*1, 116*c*2, 116*y*1, 116*y*2 for the respective inks of the magenta, the cyan, and the yellow are arranged in one array respectively in the directions to make approach to the IC chips 33*a*, 33*b*.

The nozzles 116*k*11, 116*k*12, 116*k*21, 116*k*22 for the black ink as the dark ink are formed at pitches of ½ of those for the nozzles for the other ink colors. The number of the nozzles 116*k*11, 116*k*12, 116*k*21, 116*k*22 for the black ink as the dark ink is twice the number of the nozzles for each of the other ink colors. When a document including letters or the like is recorded, it is possible to perform the recording at a high density and at a high speed.

Figure 7:
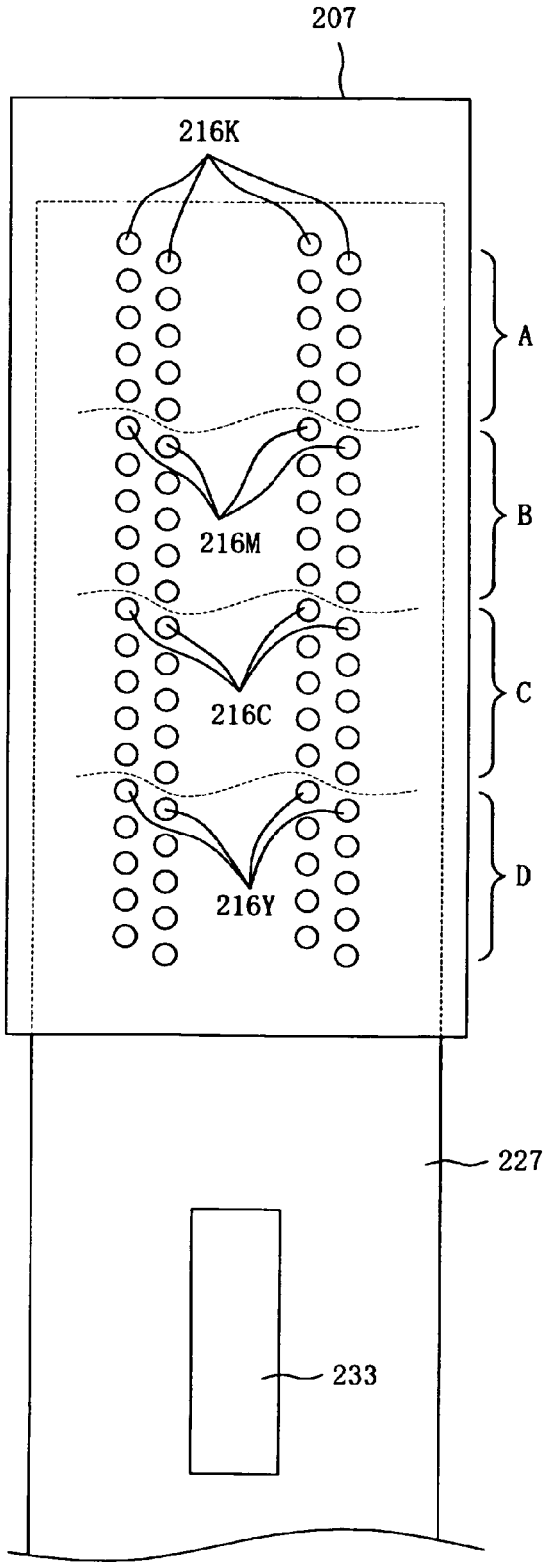
FIG. 7 shows a bottom view illustrating a recording head according to a third embodiment.

An explanation will now be made with reference to FIG. 7 about an ink-jet recording apparatus according to a third embodiment. FIG. 7 schematically shows a recording head 207 of the third embodiment.

The recording head 207 of the third embodiment has four arrays of nozzles. A flexible wiring board (wiring member)

227 extends in the extending direction of the arrays. An IC chip 233 is carried on the flexible wiring board 227. In this embodiment, the nozzles are divided into those belonging to four groups A, B, C, D arranged in the nozzle array direction. In the direction perpendicular to the arrays, four arrays of the nozzles belong to the every identical group. Specifically, those arranged in the direction directed proximally from the position farthest from the IC chip 233 are the nozzles 216*k* for the black ink as the nozzle group A, the nozzles 216*m* for the magenta ink as the nozzle group B, the nozzles 216*c* for the cyan ink as the nozzle group C, and the nozzles 216*y* for the yellow ink as the nozzle group D. That is, the IC chip 233 is arranged at the position which is separated farther from the nozzle group A corresponding to the dark ink color than from the nozzle group D corresponding to the light ink color.

Therefore, in the same manner as in the respective embodiments described above, the disturbance is inconspicuous, even when the recording with the ink of the light color is disturbed by the influence of the heat generated by the IC chip 233. The ink of the dark color is scarcely affected by the heat, and the disturbance of the recording is hardly caused. It is possible to perform the high quality recording.

Although not shown, the recording head 207 of the third embodiment is carried by being adhered with an adhesive (not shown) with respect to a head holder. Ink tanks, which correspond to the ink colors, are arranged over the nozzles which correspond to the respective ink colors of the head holder. The inks are supplied from the ink tanks to the recording head 207 such that the inks pass through tubes corresponding to the respective ink colors, and the inks are supplied via respective ink supply ports formed for the recording head 207. The inks, which are supplied from the respective ink supply ports, are distributed to a plurality of pressure chambers via manifold flow passages extending from the respective ink supply ports, and the inks arrive at the respective corresponding nozzles 216*y*, 216*c*, 216*m*, 216*k* from the respective pressure chambers.

The present invention has been described and explained above on the basis of the embodiments. However, the present invention is not limited to the foregoing embodiments at all. It is easily thought of that various improvements and modifications may be made within a range without deviating from the gist or essential characteristics of the present invention.

For example, the ink colors are not limited to the four colors. A large number of nozzle arrays or groups may be provided depending on a large number of ink colors.

In the first and second embodiments described above, the recording head is constructed by two pieces 7*a*, 7*b*. However, an ink-jet recording apparatus may be constructed with one piece of the recording head. Alternatively, an ink-jet recording apparatus may be constructed with three or more pieces of the recording head. In the third embodiment, the recording head is constructed by one piece of the recording head 207. However, an ink-jet recording apparatus may include two or more pieces of the recording head 207.

What is claimed is:

1. An ink-jet recording apparatus comprising:

a recording head which discharges inks of a plurality of colors onto a recording medium to perform recording and which is formed with a plurality of nozzle arrays for jetting the inks of the plurality of colors respectively, each of the nozzle arrays including a plurality of nozzles arranged in a first direction;

a flexible wiring member which extends from the recording head in a second direction perpendicular to the first direction and which includes a plurality of wiring groups each of which is associated with one of the plurality of nozzle arrays;

a head holder which holds the recording head; and a driving circuit which is arranged directly on the flexible wiring member and which outputs a driving signal to discharge the ink from the nozzles;

wherein a nozzle array of the nozzle arrays which jets an ink of a first color of the plurality of ink colors, is arranged in the recording head farther from the driving circuit than a nozzle array of the nozzle arrays which jets an ink of a second color of the plurality of ink colors, the first color being darker than the second color;

wherein the second color is not black;

wherein the driving circuit on the flexible wiring member is held in the head holder together with the recording head; and wherein the recording head moves in the second direction and the driving circuit is held in the head holder at an end portion in the second direction.

2. The ink jet recording apparatus according to claim 1, wherein the ink of the first color is an ink of the darkest color, and the ink of the second color is an ink of the lightest color.

3. The ink-jet recording apparatus according to claim 1, wherein as the color of the ink becomes darker, the nozzle array which jets the ink of the darker color is arranged farther from the driving circuit.

4. The ink-jet recording apparatus according to claim 1, wherein the inks of the plurality of colors include at least two inks of colors which are substantially equivalent in lightness and darkness, and a nozzle array of the nozzle arrays, which jets an ink of a color which is more frequently discharged, of the at least two inks, is arranged far from the driving circuit.

5. The ink-jet recording apparatus according to claim 1, wherein a number of the nozzles formed for jetting the ink of the first color is larger than a number of the nozzles formed for jetting the ink of a color other than the first color.

6. The ink-jet recording apparatus according to claim 1, further comprising a heat sink which is arranged in contact with the driving circuit.

7. The ink-jet recording apparatus according to claim 1, wherein:

the recording head includes two head bodies which have the plurality of nozzle arrays respectively and which are arranged in the second direction;

the flexible wiring member includes two wiring sections which are connected to the two head bodies and which extend in the second direction oppositely to each other; and the driving circuit includes circuits which are provided for the two wiring sections respectively.

8. The ink-jet recording apparatus according to claim 1, wherein the ink of the first color of the plurality of ink colors is a black ink.

9. The ink jet recording apparatus according to claim 1, wherein the driving circuit is directly fixed on the flexible wiring member.

10. The ink jet recording apparatus according to claim 1, further comprising a terminal section which is connected to the end of the flexible wiring member, wherein the flexible wiring member extends from the recording head to the terminal section and the driving circuit is arranged on the flexible wiring member between the recording head and the terminal section.

11. The ink jet recording apparatus according to claim 1, wherein the recording head moves in the second direction and the driving circuit is held in the head holder at an end portion in the second direction.

12. The ink-jet recording apparatus according to claim 2, wherein the nozzle array, which jets the ink of the lightest color, is disposed at a position nearest to the driving circuit.

13. The ink-jet recording apparatus according to claim 7, wherein the nozzle arrays for jetting the ink of the first color are arranged on sides nearer to mutually adjoining side edges of the two head bodies.

14. An ink-jet recording apparatus comprising:

a recording head which discharges inks of a plurality of colors including a first color and a second color, and the first color being darker than the second color, and which is formed with arrangement of a first nozzle group including a plurality of nozzles for jetting the ink of the first color and a second nozzle group including a plurality of nozzles for jetting the ink of the second color;

a wiring member which extends from the recording head in a direction of the arrangement of the first and second nozzle groups and which includes a first wiring group for the first nozzle group and a second wiring group for the second nozzle group;

a head holder which holds the recording head; and a driving circuit which is arranged directly on the wiring member and which outputs a driving signal for discharging the ink from the nozzles;

wherein the driving circuit is positioned farther from the first nozzle group than from the second nozzle group;

wherein the second color is not black; and wherein the driving circuit on the flexible wiring member is held in the head holder at an end portion in the direction of the arrangement of the first and second nozzle groups together with the recording head.

15. The ink-jet recording apparatus according to claim 14, further comprising a heat sink which has a part arranged in contact with the driving circuit and which is capable of thermally conducting heat generated by the driving circuit.

16. The ink-jet recording apparatus according to claim 14, wherein:

the recording head includes two head bodies which are arranged in a direction perpendicular to the direction of the arrangement;

the wiring member includes two wiring sections which are connected to the two head bodies and which extend in a direction perpendicular to the direction of the arrangement oppositely to each other; and the driving circuit includes circuits which are provided for the two wiring sections respectively.

17. The ink-jet recording apparatus according to claim 14, wherein the first color is black.

18. The ink jet recording apparatus according to claim 14, wherein the driving circuit is directly fixed on the flexible wiring member.

19. The ink jet recording apparatus according to claim 14, further comprising a terminal section which is connected to the end of the flexible wiring member, wherein the flexible wiring member extends from the recording head to the terminal section and the driving circuit is arranged on the flexible wiring member between the recording head and the terminal section.

20. The ink jet recording apparatus according to claim 14, wherein the recording head moves in the direction of the arrangement of the first and second nozzle groups.

21. The ink-jet recording apparatus according to claim 16, wherein nozzle arrays for jetting the ink of the first color are arranged on sides nearer to mutually adjoining side edges of the two head bodies.

* * * * *